US009416604B2

(12) United States Patent
Cobb

(10) Patent No.: US 9,416,604 B2
(45) Date of Patent: Aug. 16, 2016

(54) IN-LINE, HIGH PRESSURE WELL FLUID INJECTION BLENDING

(71) Applicant: ChemRight, LLC, Lafayette, LA (US)

(72) Inventor: Don B. Cobb, Houma, LA (US)

(73) Assignee: ChemRight, LLC, Midland, TX (US)

( * ) Notice: Subject to any disclaimer, the term of this patent is extended or adjusted under 35 U.S.C. 154(b) by 327 days.

(21) Appl. No.: 14/075,436

(22) Filed: Nov. 8, 2013

(65) Prior Publication Data

US 2014/0202702 A1 Jul. 24, 2014

Related U.S. Application Data

(60) Provisional application No. 61/879,659, filed on Sep. 18, 2013, provisional application No. 61/754,188, filed on Jan. 18, 2013.

(51) Int. Cl.

| | |
|---|---|
| ***E21B 21/06*** | (2006.01) |
| ***E21B 43/26*** | (2006.01) |
| ***B01F 5/06*** | (2006.01) |

(52) U.S. Cl.

CPC ..... *E21B 21/062* (2013.01); *B01F 5/0614* (2013.01); *B01F 5/0652* (2013.01); *B01F 5/0689* (2013.01); *E21B 43/26* (2013.01); *B01F 2005/0637* (2013.01)

(58) Field of Classification Search

CPC ..... E21B 21/062; E21B 43/26; E21B 21/00; E21B 2021/007; E21B 21/01

See application file for complete search history.

(56) References Cited

U.S. PATENT DOCUMENTS

| | | | | |
|---|---|---|---|---|
| 5,190,374 | A * | 3/1993 | Harms | B01F 5/205 366/165.2 |
| 2012/0127822 | A1* | 5/2012 | Noles, Jr. | B01F 3/0865 366/152.2 |
| 2013/0021868 | A1* | 1/2013 | Doolin | B01F 5/0415 366/154.1 |

* cited by examiner

*Primary Examiner* — Brad Harcourt

(74) *Attorney, Agent, or Firm* — Bracewell LLP; James E. Bradley

(57) ABSTRACT

A mixing device has an elongate shell, an inlet, an outlet and at least one shear orifice between the inlet and the outlet. A hydration passage is located between the shear orifice and the outlet. The hydration passage has a flow area greater than a total shear flow area of the shear orifice, greater than an inlet flow area of the inlet and greater than an outlet flow area of the outlet. During operation, a polymer is mixed in a fluid flow flowing to the intake of a positive displacement pump, which pumps the fluid through the mixing device and into an injection conduit leading into a well. The shear orifice produces high shear separation of molecules of the polymer. The hydration passage causes hydration under pressure of the various polymer molecules in addition to blending the various chemicals and/or gases with other components of the fluid flow stream.

25 Claims, 6 Drawing Sheets

IN-LINE, HIGH PRESSURE WELL FLUID INJECTION BLENDING

CROSS-REFERENCE TO RELATED APPLICATIONS

This application claims priority to provisional applications 61/879,659, filed Sep. 18, 2013, and 61/754,188, filed Jan. 18, 2013.

FIELD OF THE DISCLOSURE

The present disclosure relates in general to injecting fluids into a well, and in particular to methods and devices that blend additives in a high pressure, in-line positive displacement sequential process.

BACKGROUND

Fluids are injected into wells for various purposes, such as drilling and hydraulic fracturing ("fracing"). During the fracing process, a blender at the well site mixes various chemicals and proppants, such as sand, with water. The chemicals include friction reducers and viscosity enhancers. The blender feeds the mixture to high pressure pumps that inject the mixture into the well to create fractures. The pressure may exceed 10,000 psi.

With wells having long horizontal sections, it is common to perforate the casing at a lowest zone, frac the lowest zone, then install a plug. The operator then perforates a next to the lowest zone and repeats the process. It is not uncommon for an operator to perforate twenty or more zones and install twenty or more plugs in a well. Afterward, the operator lowers a drill string into the well and drills out the frangible plugs.

While drilling out the plugs, the operator circulates drilling fluid with high pressure pumps. The output pressures are typically in the 2500 to 5000 psi range and the flow rates at least 20 gpm (gallons per minute). It is important to circulate the cuttings or fragments of the plugs being drilled up with the drilling fluid. As a result, an operator typically adds friction reducers and chemicals or viscosifiers such as liquid gels to the well fluid in a blender. The friction reducers and viscosifiers are normally polymers. After the desired viscosity has been reached, the operator delivers the drilling fluid from the blender to the high pressure pumps. Blending can be time consuming, which adds to the total time to drill out the wells containing the temporary frac plugs.

Mixing devices and systems such as low, or zero, pressure surface blending systems, low pressure batch mixing systems, low pressure surface hydration systems and other such systems primarily depend on time. Conventional blenders use atmospheric tanks, internal stirring paddles, and/or some form of non-positive suction and/or displacement high pressure jetting. The blending unravels and shear stresses component molecules of the chemicals being introduced. The oil and gas industry has historically used small mobile high pressure jetting devices inside surface blending tanks as mentioned above that suck in the fluid and chemicals, and/or polymers, in a non-positive fashion as compared to total tank volume. The jetting devices ultimately jet the mix through the high pressure jet nozzles, attempting to shear stress the molecules, ultimately allowing for hydration of the entire tank mix through time. Due to the nature of this not being a positive displacement process as compared to total tank volume, and having to recirculate the fluid mix over and over in an effort to ensure that all molecules are shear stressed, this process can take up to several hours to achieve near full hydration of greater than 90%. Blending is done in efforts to bring multiple components ultimately into one homogeneous and consistent blend of quality product with enhanced chemical and physical characteristics.

As will be apparent from the previous paragraph, the prior art teaches that the various fluid types, chemicals, polymers (gels), minerals and/or gases are mixed, blended and hydrated on the low pressure side, or upstream, of the high pressure positive displacement liquid fluid pump. This low pressure mixing is normally done utilizing a variety of apparatuses and a mixture or combination of non-positive suction and/or displacement paddle mixers, mixing jets, pipes, and batch mixing tanks. A batch mixer is generally equipped with a means of adding dry and liquid chemicals, an agitation or circulation system and a manifold system to deliver the prepared fluid to storage tanks or treating pumps and/or other applications as previously described. The blended component stream is then transferred to the high pressure positive displacement liquid fluid pumps utilizing low pressure centrifugal pumps. As the homogeneous, or non-homogeneous, blend moves from its low pressure environment to and through the high pressure positive displacement liquid fluid pumps, the pumps generate the high pressures required in efforts to move the component blend fluid stream down pipes or other apparatus into and down the wellbore.

SUMMARY

A method of mixing and injecting a fluid into a well is disclosed that includes providing a mixing device with an elongate shell, an inlet, an outlet, at least one shear producing element, such as an orifice, between the inlet and the outlet, and a hydration passage between the shear orifice and the outlet. The hydration passage has a flow area greater than a total shear flow area of the at least one shear orifice, greater than an inlet flow area of the inlet and greater than an outlet flow area of the outlet. The inlet of the mixing device is connected to the discharge of a positive displacement pump, and the outlet of the mixing device to an injection conduit leading into the well.

A viscosifier, normally a polymer, is introduced into the fluid flow, creating a partially mixed fluid that flows to an intake of the positive displacement pump. The pump increases the pressure of the partially mixed fluid to at least 250 psi and pumps the partially mixed fluid into the mixing device. The partially mixed fluid flows through the shear orifice, causing shearing of molecules in the polymer, and into the hydration passage, where blending the molecules of the polymer with other components in the fluid flow take place to create a more viscous fluid. The more viscous fluid flows through the injection conduit into the well.

The inlet flow area of the mixing device is at least equal to a flow area of the discharge of the pump. The outlet flow area of the mixing device is at least equal to a flow area of an inlet of the conduit. The total shear flow area is at least equal to the inlet flow area and to the outlet flow area.

A plurality of vanes may be located between the shear orifice and the hydration passage to swirl the fluid exiting the shear orifice as the fluid flows into the hydration passage. A venturi or flow dampener may be located between the shear orifice and the hydration passage. The venturi has a converging portion leading to a throat and a diverging portion leading from the throat in a downstream direction. The venturi and the vanes diminish turbulence a the fluid flows through them.

The in-line mixing device is useful for any mixing or blending of aqueous or oil blends or mixtures which require or will benefit from high shear conditions. Examples of such mixtures or blends include, for example, those containing dry or partially hydrated polymeric viscosifiers, clays, chemical additives and the like.

The shear device causes molecular unraveling of the polymeric additives via shear stressing, homogeneous mixing/blending, ending with near full and hydration of the various organic "additive" components prior to exiting the device, thus transforming finished product into, generally speaking, non-Newtonian fluid(s).

In more detail, the present disclosure relates to an in-line, high-pressure shearing, blending, and hydrating device that is utilized in, among other applications, completion operations in hydrocarbon wells to quickly hydrate liquid gel and friction reducing polymers, and other chemicals and gases, "in real time" downstream of the high pressure pumps and prior to being pumped into the wellbore via coiled tubing or stick pipe. The in-line shearing device is provided with multiple internal components having geometric configurations and mathematical dimensions that are enclosed in one single-unit external housing, or multiple-unit external housings, that utilize internal high pressure generated by an external source to produce high pressure in-line molecular unraveling via fluid shear stress. Any real fluids, liquids and gases included, moving along a solid boundary will incur a shear stress on that boundary; the no-slip condition dictates that the speed of the fluid at the boundary "relative to the boundary" is zero, but at some point from the boundary the flow speed must equal that of the fluid, resulting in shearing. The in-line mixer causes homogeneous blending with a smooth variation of properties with no discontinuities or jumps. The in-line mixer causes hydrating, which is a cleavage of chemical bonds by the addition of water, of various liquids, polymers (gels), chemicals, minerals, and/or gases.

The high pressure in-line shearing, blending/mixing and hydration device of the present disclosure is used on the high pressure side of the high pressure positive displacement liquid fluid pumps versus upstream on the low pressure side of the high pressure positive displacement liquid fluid pumps, generally in conditions where the internal pressures inside the positive displacement high pressure in-line shearing, blending/mixing and hydrating device will be greater than 250 psi and less than 10,000 psi, with fluids being displaced in a positive nature through the device at rates normally ranging from 20 gallons per minute to 210 gallons per minute, or greater.

The high pressure in-line shearing, blending/mixing and hydrating system referenced herein is used downstream of the positive displacement high pressure liquid fluid pumps used to carry out operations of various nature in oil and natural gas field operations. What differs greatly from said device/s and current efforts is the fact that the mixing device is of a positive displacement nature and incorporates all mentioned efforts (ie, unraveling via shear stresses, mixing, blending and ultimately hydrating) in one sequential positive displacement high pressure progressive order process, saving great amounts of time, footprint, and arguably creating a more homogeneous and consistent blend than anything currently being used on the market. Additionally, economies result from the ability to achieve this process using energies already existing and in place on oil and natural gas wellsite operations in which such energies are generated either by the high pressure liquid fluid pumps and/or by the pressures and energies of the oil and/or natural gas well itself.

Examples of such uses in oil and natural gas operations can include, but not be limited to, wellbore cleaning, reservoir fracturing operations, gravel packing, gravel pack fracturing, frac plug drilling operations, and removal of normal scale, sand or other debris in wellbore operations. The definition of the difference between high and low pressure for the purposes of this application, and for the intentions of definition, shall be defined as greater than 250 psi and/or a pressure in excess of the downhole pressure.

The apparatus and process of the present disclosure addresses the need for a dynamic and high pressure blending, shearing/mixing and hydrating system adapted for in-line blending at high pressures of specific chemicals of the types used to modify viscosity and other physical characteristics, such as friction reducers used in wellbore treating applications. The majority of friction reducers used in the oil and natural gas industry are shear stress sensitive and are well suited for use in conjunction with the high pressure in-line shearing, blending/mixing and hydrating device of the present disclosure, and particularly, on the downstream, high pressure side of positive displacement liquid fluid pumps allowing for full positive displacement of the fluid/chemical mix through the device and allowing for what is thought to be near instant unraveling via shear stressing, blending/mixing and hydration of chemicals and gels under high pressure. So far as is known, no other device is known in the market that uses the positive energy and positive pressure of the oil or natural gas well itself, as well as, the positive pressure of the high pressure positive displacement liquid fluid pumps at the wellsite, to ensure proper and near instantaneous full unraveling via fluid shear stressing, blending/mixing and hydrating of chemicals and polymers. As stated earlier, devices used in efforts to unravel chemical and polymer molecules using shear stressing with high pressure jetting action and high pressure jetting nozzles has been used in the industry for many years, however the combination of unraveling molecules via high pressure fluid shear stressing, blending/mixing and allowing for hydration near simultaneously, although sequentially, is new to the oil and natural gas service industry. So far as is known, this real-time approach using existing energies and pressures to force the hydration of molecules under high pressure is an art not previously used in wellsite processes of the oil and natural gas businesses.

The high pressure shearing and blending device of the present disclosure is utilized, for instance, in conjunction with coil tubing and/or workover rig completion operations, where it is installed downstream of high pressure pumps. Chemicals (friction modifiers and viscosity modifiers, for instance) are introduced using readily-available equipment of types known in the art, for instance, via pump displacement tanks, hopper or by surface injection system. Placement downstream of existing coil tubing or workover rig positive displacement pumps shears and allows for hydration of all chemical and gel molecules, producing variable viscosities almost "on demand" (on information and belief, it may require several hours to hydrate using conventional equipment of the type described above), and enables the fluid to be downhole within minutes. Due to its construction, the shearing and blending device of the present disclosure has a small footprint on location, can be used with or without wellsite personnel on site, and because it has no internal moving parts and no energy source is required, requires minimal maintenance.

Other objects, and the many advantages of the present disclosure, will be made clear to those skilled in the art in the following detailed description of the preferred embodiment (s) of the disclosure and the drawing(s) appended hereto. Those skilled in the art will recognize, however, that the embodiment(s) of the present disclosure that are described herein are only examples of specific embodiment(s), set out for the purpose of describing the making and using of the present disclosure, and that the embodiment(s) shown and/or described herein are not the only embodiment(s) of method performed in accordance with the teachings of the present disclosure.

The present disclosure meets the above-described objects by providing a high pressure in-line positive displacement sequential process allowing for molecular unraveling via shear stressing of various fluids, chemicals, polymers (gels), minerals and/or gases in a primary fluid component stream, additionally said device allows for homogeneous mixing/blending, and ending with near full and instantaneous hydration of various organic "additive" components prior to exiting such device in said fluid stream and components thereof.

In another aspect, the present disclosure provides a method of properly blending, shearing and mixing of chemicals, including polymers (gels) real time, with a specific, desirable and measurable outcome, without the need of/for pre-mixing or batching mixing of the chemicals or polymers prior to use.

Figure 2:
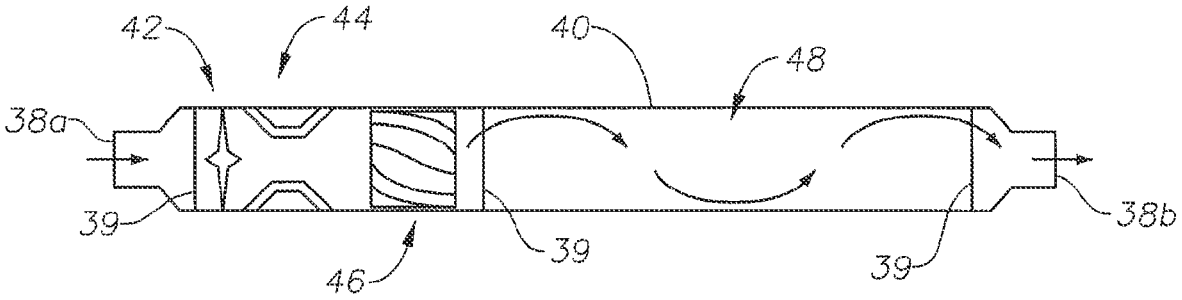

A preferred embodiment of a dynamic mixing system for high pressure in-line shearing, blending and hydrating that is constructed in accordance with the teachings of the present disclosure is shown schematically in FIG. 2.

Figure 3:
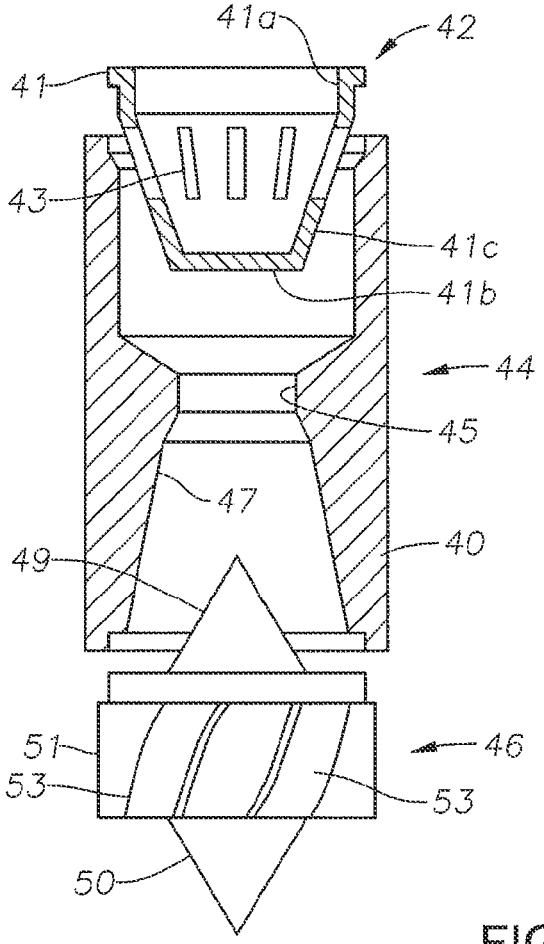

FIG. 3 is an exploded schematic diagram of some of the internal components of the dynamic mixing system of FIG. 2.

Figure 4A:
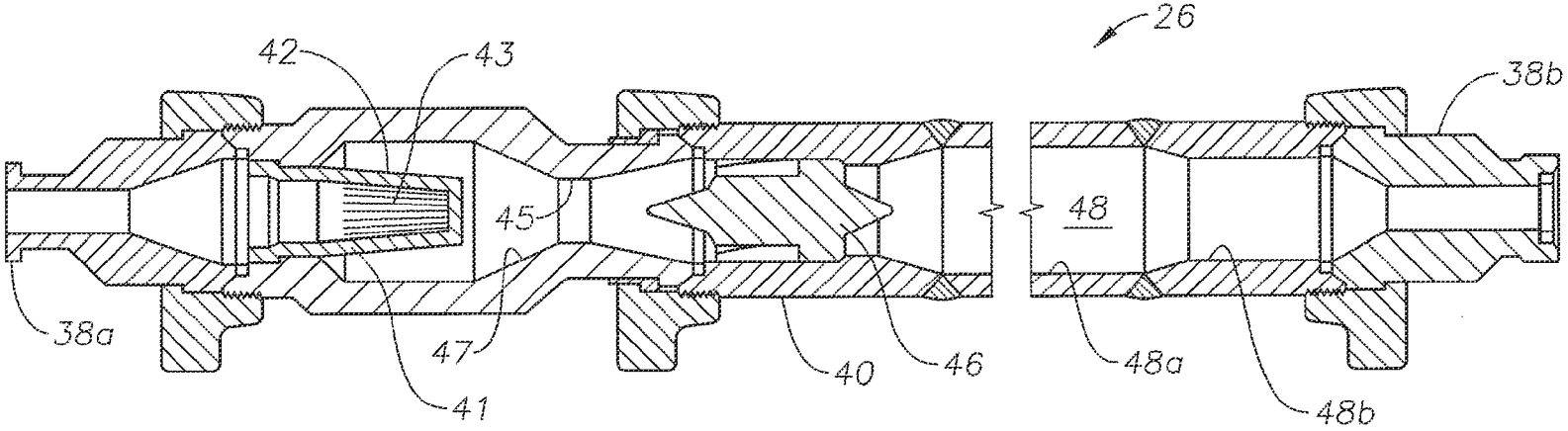
Figure 4C:
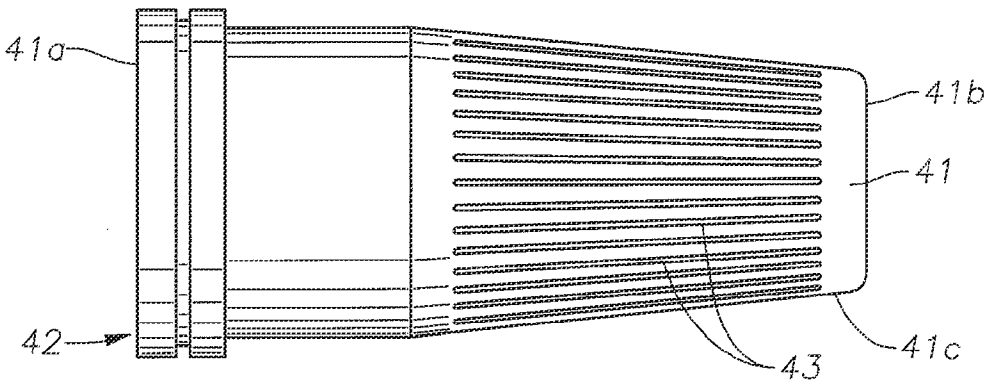
Figure 4B:
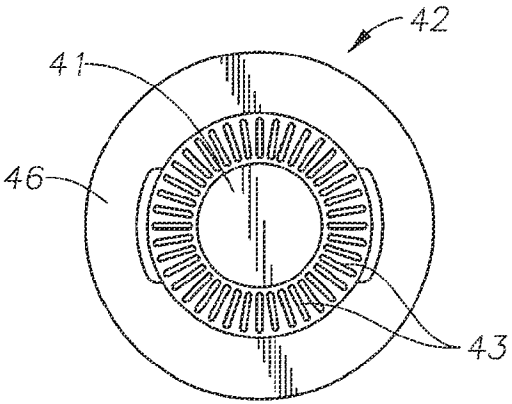
Figure 4F:
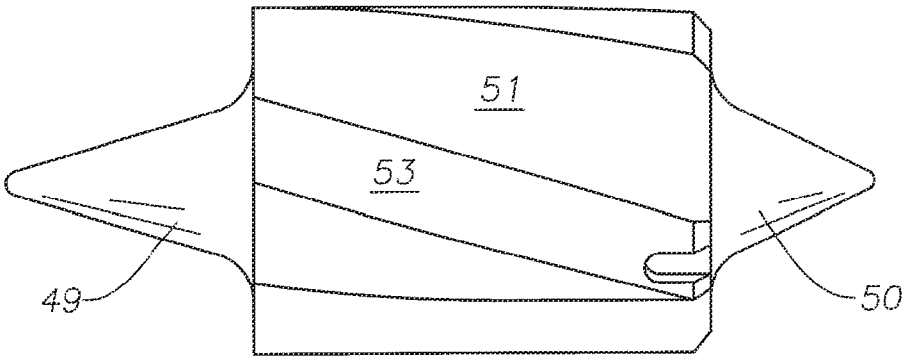

FIG. 4A is a longitudinal sectional view of a first embodiment of a high-pressure, in-line shearing and blending device that is constructed in accordance with the teachings of the present disclosure.

FIG. 4B-4G illustrate various components of the device of FIG. 4A.

Figure 5:
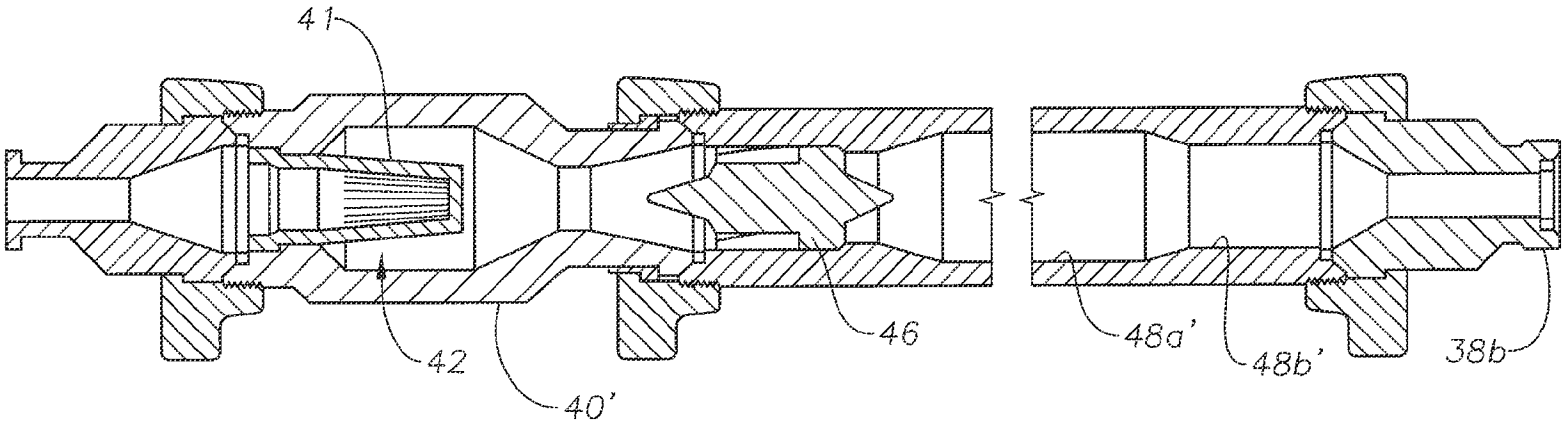

FIG. 5 is a longitudinal sectional view of a second embodiment of a high-pressure, in-line shearing and blending device that is constructed in accordance with the teachings of the present disclosure.

Figure 6:
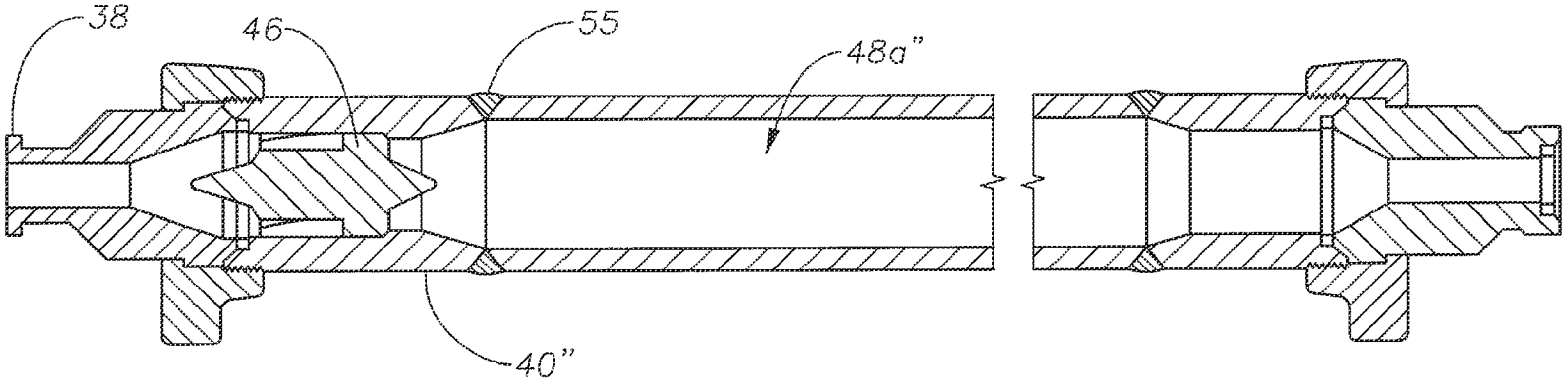

FIG. 6 is longitudinal sectional view of a third embodiment of a high-pressure, in-line shearing and blending device that is constructed in accordance with the teachings of the present disclosure.

Figure 7:
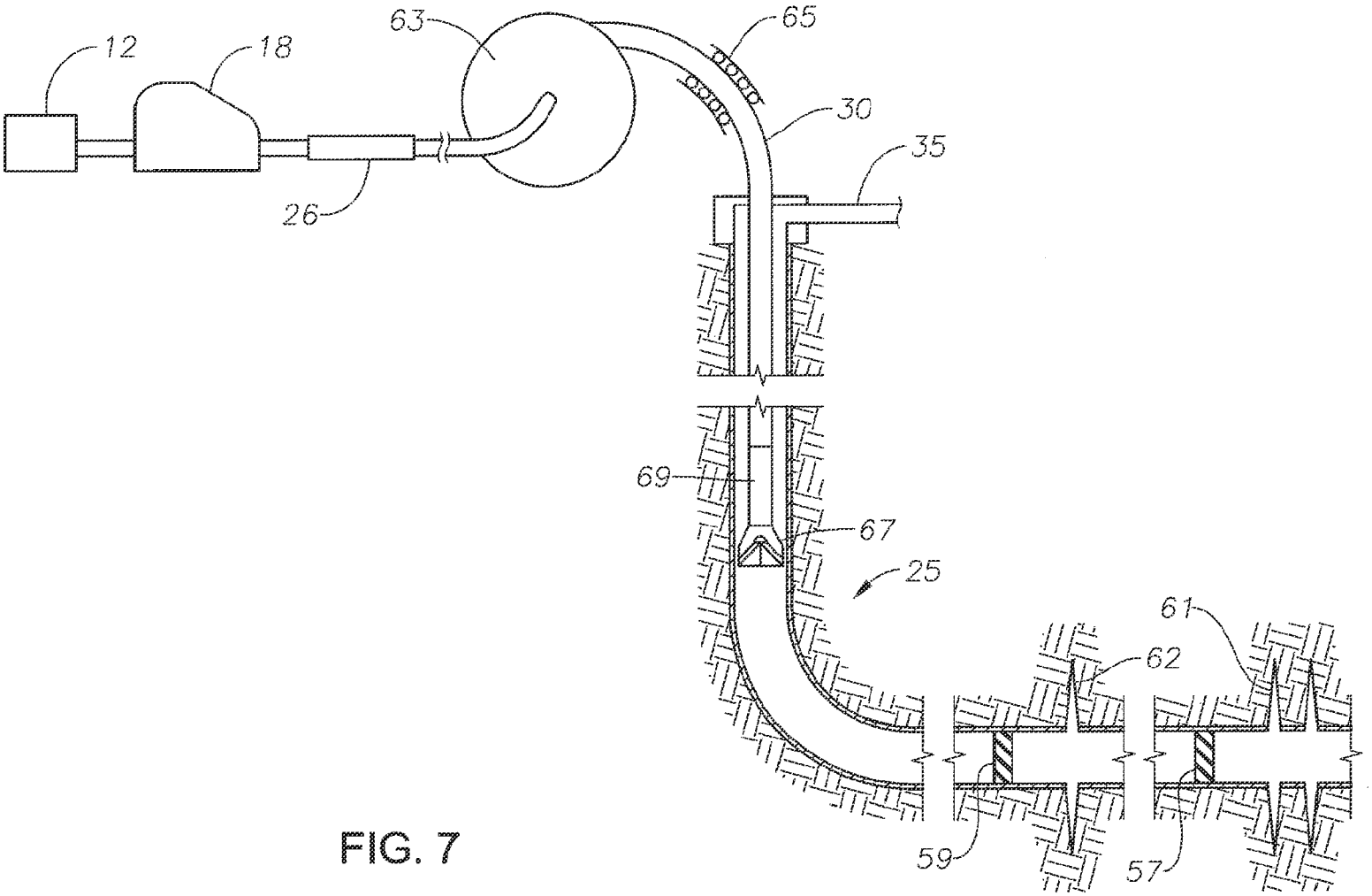

FIG. 7 is a schematic view illustrating temporary plugs being drilled from a well employing one of the shearing and blending devices illustrated in FIG. 4A-G, FIG. 5 or FIG. 6.

DETAILED DESCRIPTION

The device utilizes said combination of internal devices, containing geometric configurations and mathematical dimensions specific to the unraveling and blending of such molecules which are generally in a concentrated form solution at some stage and via shear stressing and a hydration chamber containing geometric configurations and angles allows for a process in which such fluids may enter said device as a Newtonian fluid and exit as a homogeneous non-Newtonian fluid. The initial phase of the process incorporated in said device readies molecules, as they move through the ensuing phases towards the ultimate final hydrating, or hydrolysis, phase of the process ending with a fully-blended, ready to use product of a desired nature and fluid viscosity. While all processes internal to the device are working sequentially (unraveling under shear stress, blending/mixing, relaxing and hydrating) inside the high pressure in-line shearing, blending and hydrating device, the final desired result is a blended, homogeneous and consistent, readily usable product that exits the device.

In the case of polymers (gels), specifically Xanthan gum, a polysaccharide polymer, the unraveling from a liquid concentrated or dry state, the wetting and shear stressing, and the ultimate hydration (the beginning of molecule degradation) on face value by definition may appear to be counterproductive to an end desired result of the Xanthan gum molecule, as it may be, however this allows said molecule to go through its progressive life cycle, transforming it from a balled up, non-useable product from its pre-H2O-solution concentrated, or dry form, state into a useful thickening agent near instantly with very specific and measurable viscosities. From the beginning of this life spend process, the useful life of the Xanthan gum polymer time-wise can be utilized in many processes in which time of the life cycle of the polymeric molecule can be predetermined and used to the advantage of the process or product in which the Xanthan gum polymers are used. Additionally, the device of the present disclosure has been engineered in its internal geometric configurations and mathematical dimensions so not to create pressure increases above and over the effective inlet and exit areas of the device. The pseudoplastic nature, which is the measure of a fluid's resistance to flow—decreases with an increasing rate of shear stress nature, of Xanthan gum lends itself well to applications where the high pressure in-line shearing, blending/mixing and hydrating device is incorporated as a practical solution to bringing the polymer to near full hydration instantly without increasing inlet or exit pressures in any significant or material way. To clarify that statement, the singular effective flow area of each individual component of any, and all, of the internal components of the device, geometric configurations and mathematical dimensions are greater than the effective flow area singularly of the inlet, or exit, internal flow areas of the device.

The internal components of the device, containing geometric configurations and mathematical dimensions, are completely enclosed within an external shell, or shells, and sealed off to external atmospheric pressures and the external shell, or shells, are tested and certified to specific internal differential pressures. In more detail, the present disclosure may receive several products, or agents, via one singular and primary liquid component stream that may have up to several different various liquid types, chemicals, polymers (gels), minerals and/or gases mixed into the one singular and primary component liquid stream yet not fully blended together as one homogeneous blend, comingled as one final product or hydrated as one mixture. As the single liquid stream of multiple products or components moves into the high pressure in-line shearing, blending/mixing and hydrating device, the transformation begins from being completely separate components in one liquid component stream to ultimately becoming one homogeneous mixture of near full mix greater than 90%, with near full hydration of polymers greater than 90% upon exiting the high pressure shearing, blending/mixing and hydration device. The homogenous blend may be immediately used upon exiting the device as one final product without the need of additional shearing, blending/mixing and/or hydrating of such liquids and the liquid stream components.

The sequential working process of the internal components of the high pressure in-line shearing, blending/mixing and hydrating device of the present disclosure are as follows: as the post, downstream of, high pressure liquid fluid pump component fluid stream enters the device, the fluid immediately encounters the first internal component of the device, the removable shear stressing component. This component is of a nature, via machined slots of a very specific slot gap, machined slots of a very specific length, and a wall thickness of a very specific thickness of said slots so that maximum interface and time is allowed as the chemicals and polymers move through such slots so to ensure maximum shear stress is applied without the destruction and/or breaking up into various pieces such individual chemical and/or polymer molecule chain(s).

The byproducts, or consequences, of this transformation on the outlet (exit) side of the internal shear device are several. The outlet creates a small vacuum area towards the top end of the external area of the shearing device and creates super turbulent flow upon exiting the slots at extremely high rates of fluid velocity. These byproducts of the shear stressing, necessary to unravel the chemical and polymeric molecules, are undesirable, and the design of the device of the present disclosure contains and eliminates these byproducts as quickly as possible. First, addressing the super turbulent flow and high rates of velocity as the fluid component stream exits from the shear device slots into the inside of the external shell housing and to manage these two unwanted post shear stress byproducts (super turbulence and high rates of velocity), two engineering solutions were applied, one solution to the external housing and one solution to the removable internal shear device itself. Specifically, the internal shear device was engineered with an external surface oriented at a downward angle (from a greater outside diameter at the top to a progressively smaller outside diameter towards the bottom), allowing for a downward angled flow that does not put the super turbulent flow, at high rates of velocity, exiting the internal shearing device slots at a direct 90 degree angled interface with the inside of the external shell housing. This configuration greatly reduces the chances of molecular destruction in the fluid component stream, and chemicals and polymers therein, upon impact with the inside of the outer shell housing while moving at high velocities. Next, the inside diameter of the outer shell housing, directly opposite the outside diameter of the internal shear device and slots, was configured to allow as much "fluid cushion" as possible without making the outside diameter of the housing too large. The relevance of this configuration is that the device is rated and certified to several thousand psi (pounds per square inch) inside diameter working pressure. Thus, the larger the inside diameter the thicker the wall thickness of the external housing, leading to a much larger and heavier device to provide sufficient "fluid cushion" to guard against molecular destruction upon impact with the inside of the outer shell housing.

An additional undesirable consequence of the shear stressing process is the creation of a small vacuum area, or vortex, which is a region within a fluid where the flow is mostly in a spinning motion about an imaginary axis, straight or curved, between the very top of the outside diameter of the device, which is dead area between the outside of the top of the shear device and the inside of the outer shell housing, and the top of the outside of the slots on the device as the fluid component stream moves through the slots and downward further into the device. This vacuum, or vortex, is actually used by some low pressure products on the market today in a positive way to assist in low pressure efforts to pull component products and chemicals into a low pressure component fluid stream to move such low pressure component fluid streams into tanks that are open to the atmosphere in known hydrating and mixing methods prior to being sent to the high pressure liquid fluid pumps and ultimately down the wellbore of oil and natural gas wells via pipes or other apparatuses.

Containment of this vacuum, vortex, and super turbulent flow area of the device is important to the next steps of the sequential order of the process. This containment was accomplished in such a fashion as to reduce the inside diameter of the outer shell adjacent to and below the internal shearing device at a relatively steep angle inward below the shearing device itself, but not so steep as to have the effect of degrading the polymeric molecules flowing through and by it, but at an angle steep enough to keep the size of the device as small and short as possible. The result of this design is a circular orifice sized with a flow area greater than the effective inlet area of either the initial inlet internal area or the ultimate exit internal area of the device, these two areas being the two smallest inside diameter effective areas of the device. Other relevant information resulting from this design will become clear from the following description of the sequential process of the present disclosure, but it is also noted that partly as a consequence of this design, the high pressure device of the present disclosure is substantially smaller than the apparatus currently used for mixing and blending (on the low pressure side of the high pressure liquid fluid pump) which are must be of much greater size and footprint to achieve similar fluid rheology results in a final blended/mixed and more viscous fluid product.

As the fluid component stream moves from the shear stressing area, in which the main objective is to unravel the chemical and polymeric molecules, the fluid stream moves through the above-described circular orifice to the next phase of the device and process. As the component fluid stream departs the circular orifice, having a geometric configuration and configuration as described above, the fluid stream begins to slow down in velocity due to pressure drop, which is the difference between two points of a fluid carrying network. Pressure drop occurs with frictional forces, caused by the resistance to flow, on a fluid as it flows through a tube) caused by an engineered enlarging of the inside diameter of the device downstream of the circular orifice. The fluid component stream then encounters the next main component of said device, a non-moving machined spiral device of a mathematical and geometrical configuration that has wide openings in the form of machined slots spiraling downward allowing the flow stream to freely move between the outside solid body of the spiraled device and the inside of the outer shell housing. The main function of this component is to provide a transition phase in which the chemical and polymer molecules of the component fluid stream are, instead of being oriented in every direction, lined up symmetrically and readied for the large pressure drop chamber/hydration area into which they next move for nearly instantaneous, nearly full hydration under pressure. By the configuration of its mathematical and geometrical spiral design, this component of the present disclosure also acts a buffer and barrier in slowing the transitional component fluid stream down, thus eliminating any possibility of the prior super turbulent flow pattern entering the large pressure drop hydration chamber area.

The next and final component of the high pressure device of the present disclosure, the large pressure drop chamber-hydration area, is the area in which the component fluid stream physically changes from basically a Newtonian fluid with minimal non-Newtonian characteristics, to a fluid stream of a nature that is basically fully non-Newtonian. In the embodiment shown, this component of the device is incorporated into the outer shell and is of a specific inside diameter and length that incorporates geometric and mathematical angles engineered to effectively accomplish this transformation. However, those skilled in the art who have the benefit of this disclosure will recognize that this component of the device can be changed depending on the nature of the particular application. For instance, this pressure drop chamber-hydration area may need to be lengthened, or of a larger inside diameter depending upon such variables as fluid stream component types, rates of volumes expected, and percent of full hydration required. Further, the pressure drop chamber-hydration area is shown in the drawings herein as a component part of the single outer shell for the purpose of reducing the footprint of the high pressure device of the present disclosure. In alternative embodiments, this step in the mixing/blending process is accomplished in a completely separate device, connected to and working in sequential order with the other internal components of the high pressure in-line shearing, blending/mixing and hydrating device. The large pressure drop chamber-hydration area, or so-called "spa area," of the device provides the point in the process at which the component fluid stream relaxes due to a pressure drop that takes the component fluid stream from a turbulent flow regime to a non-turbulent flow regime with nearly all chemical and polymeric molecule chain(s) fully elongated and relaxed. The large pressure drop chamber-hydration area therefore allows a fleeting moment while the component stream is inside the device, before the fluid is subjected to the high pressure of the wellbore pressures against which the high pressure liquid fluid pumps, along with the friction pressures of the piping and other apparatuses that are being pushed against in the wellbore, forcing molecular hydrolysis to take place near instantly under high pressure, thus transforming the physical properties of the component fluid stream from near fully Newtonian to fully non-Newtonian as it exits the device. In the hydration area of the device, the fluid therein is subjected to the high pressure of the wellbore and to the friction pressures working against the high pressure pumps. These high pressures are required in the hydration area and necessary in creating near instant hydration of the polymers. In the hydration chamber, the flow is laminar, but the pressure within are the same as they would be in the piping either before or exiting the in-line mixer.

Although described herein as having particular application to certain oil and natural gas field operations, those skilled in the art who have the benefit of this disclosure will recognize that the present disclosure may be utilized to advantage in many applications in which component streams are combined and the resulting product stream is required to be of a homogeneous and consistent blend of quality product with enhanced chemical and physical characteristics that began as multiple components with multiple properties of different natures and finish as one ready to use final, useable product of a desired nature. Representative industries may include petroleum refining, product blending, chemical blending, blending of paints and coatings, food processing prior to packaging, medical applications as well as pharmaceutical and biomedical manufacturing and processing, and many other industries. The present disclosure being described in a general nature only with reference to oil and natural gas field operations for the purpose of exemplifying the disclosure, but not with the intention of limiting its scope in any way as to how it may be used beyond said oil and natural gas field operations.

In a typical oilfield installation, an in-line filter screen is installed at the outlet from the high-pressure pump with an in-line check valve downstream of the filter screen. A nitrogen feed line is connected into the line downstream of the check valve and, the nitrogen and fluid move together to an in-line "T" that is provided with a bleed off valve. The fluid and nitrogen combination then moves to the high-pressure blending and shearing device of the present disclosure and exits to the coil unit.

Figure 1:
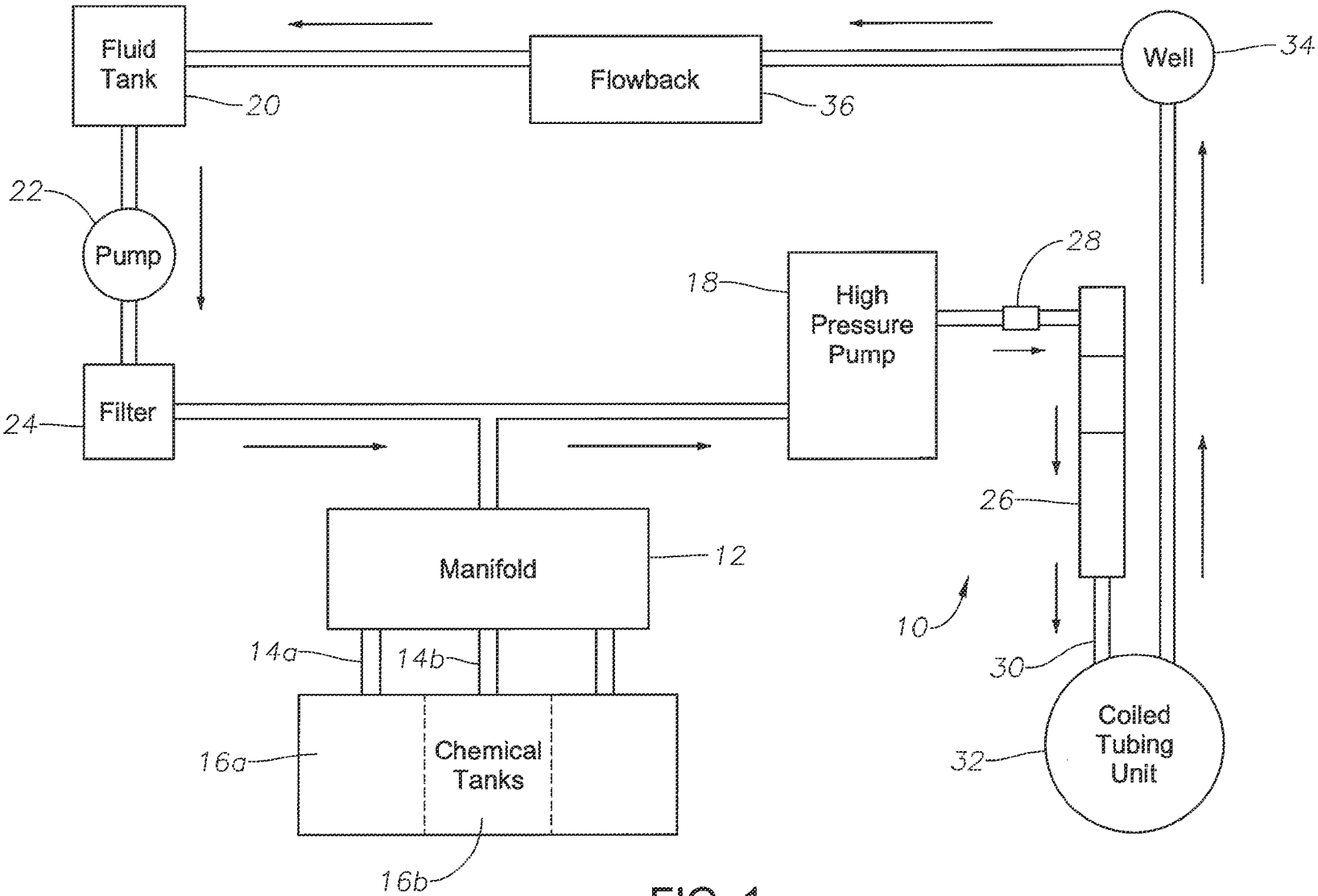
FIG. 1 is a schematic diagram of a chemical injector system utilizing in-line high pressure device for dynamic mixing that is constructed in accordance with the teachings of the present disclosure.

In the embodiment shown, FIG. 1 is a schematic diagram of a chemical injector system utilizing high pressure in-line shearing, blending and hydrating as configured for injecting chemicals into a wellbore during frac plug drilling. The system 10 includes a manifold 12 into which several lines 14*a*, 14*b*, etc. are connected, each line 14*a*, 14*b*, etc. communicating with a respective holding tank 16*a*, 16*b*, etc. containing a component chemical. A high pressure, positive displacement pump 18 pulls fluids through manifold 12 from a holding tank 20, a centrifugal pump 22 and/or filter 24 being optionally provided for handling of fluid from tank 18 if needed. The in-line mixer 26 of the present disclosure is located downstream of pump 18, a suitable screen filter 28 being provided between pump 22 and mixer 26, and the output flow from mixer 26 is directed through conduit 30 through, for instance, a coil tubing unit (shown schematically at reference numeral 32) into the wellbore 34. Valves and piping as known in the art, all indicated generally at reference numeral 36, are provided for flowback into holding tank 20. High pressure pump 18 pumps against wellbore pressure and friction pressure of conduit 30, which creates a high pressure within in-line mixer 26, An embodiment of a high pressure apparatus 26 for in-line shearing, blending and hydrating that is constructed in accordance with the teachings of the present disclosure is shown in more detail in FIGS. 2 and 3. The apparatus 26 is provided with suitable connectors at inlet 38*a* and outlet 38*b* and is constructed in the form of a tubular shell 40 with threaded breaks 39 to provide access to internal components for maintenance and other purposes as known in the art. Inlet 38*a* is preferably at least equal in flow area to the discharge of pump 18. Outlet 38*b* is preferably the same in flow area as inlet 38*a* and at least equal in flow area to the inlet of conduit 30.

Shell 40 encloses four basic internal components, and additional components as may be required for a particular application and/or by such factors as the composition of the component stream. Each component is mounted in the internal diameter (I.D.) or passage of shell 40 in such a way as to be removable from shell 40. Upon entry into shell 40, the component stream is subjected to in-line shear by shear device 42 that provides the dynamic mixing of the chemicals in the stream. Shear device 42 is constructed in the form of a body 41 (see FIG. 3A) that extends inwardly toward the center axis of shell 40 and therefore occludes a portion of the I.D. of shell 40. In the example shown, body 41 has an open upstream end 41*a*, a closed downstream end 41*b* and a frusto-conical side wall section 41*c* with a smaller diameter at the downstream end 41*b*. A plurality of slots 43 are formed in side wall of body 41 and the component stream, which is under high pressure as it passes through shear device 42, is forced through slots 43, inducing shear forces in the component stream. The upstream end of body 41 is sealed in the upstream end of the passage extending axially through shell 40. The particular shape of body 41, the size and lay-out of the slots 43 in body 41, and the proportion of the I.D. of shell 40 that is occluded by body 41 are all variables that are optimized depending upon factors such as the particular application, ambient conditions, the composition of the component stream, and other factors known to those skilled in the art. As discussed above, however, the body 41 having the slots 43 formed therein converges so that the flow exits slots 43 at an angle other than 90 degrees or normal relative to the portion of the inside wall of shell 40 surrounding frusto-conical portion 41*c*. Also, the inner diameter of shell 40 surrounding frusto-conical portion 41*c* is considerably larger than the outer diameter of frusto-conical portion 41*c*, resulting an annular space for the discharge of fluid from slots 43. The inner diameter of shell 40 surrounding frusto-conical portion 41*c* may be cylindrical.

Further, the slots 43 are of a very specific slot gap ranging between about 0.001 and about 3.00 inches, machined to a specific length ranging from about 0.01 to about 10.00 inches, and a specific thickness ranging from about 0.001 to about 3.00 inches, all ranges being specified for a shell having an internal diameter ranging from about 3.0 to about 15.0 inches, so that maximum interface and time is allowed as the chemicals and polymers move through such slots so to ensure maximum shear stress. The total flow area of slots 43 is at least equal to the flow area of the inlet 38*a* and of the outlet 38*b* of shell 40. Of course those skilled in the art who have the benefit of this disclosure will recognize that the size and thickness ranges recited herein may be scaled up or down depending upon the internal diameter of the shell in which the body 41 is mounted.

Downstream of the in-line shear device 42 is a vacuum control area and flow dampener or venturi 44, which in the embodiment shown is constructed in the form of an area of reduced diameter in the I.D. of shell 40, forming a choke, or throat 45 and a downstream conically-shaped diverging area 47 into which the component stream passes upon exiting throat 45. Flow dampener 44 has a converging section in its passage that joins the upstream side of throat 45. As with in-line shear device 42, a number of factors affect the shape and other variables of vacuum control area and flow dampener 44. For instance, the particular shape and diameter of throat 45, the axial length of throat 45, the length of conically-shaped area 47, the flare in the diameter of conically-shaped area 47, and other structural variables of the vacuum control and flow dampener 44 can all be changed depending upon these many factors and others known to those skilled in the relevant art. In the embodiment shown, the diameter of throat 45 ranges from about 1.00 inches to about 14.0 inches relative to a shell 40 having an internal diameter ranging from about 3.0 to about 15.0 inches. The diameter of throat 45 is at least equal to the inner diameter of the inlet 38*a* and of the outlet 38*b* of shell 40. Also, the total flow area of slots 43 is approximately the same as the flow area of throat 45.

Figure 4G:
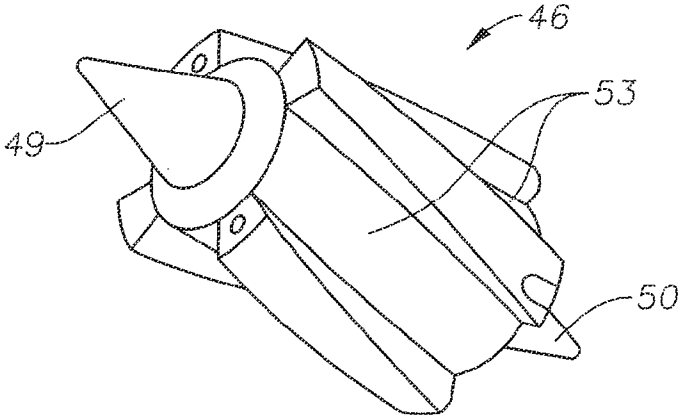
Figure 4E:
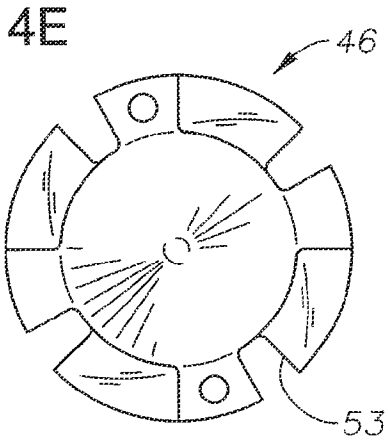
Figure 4D:
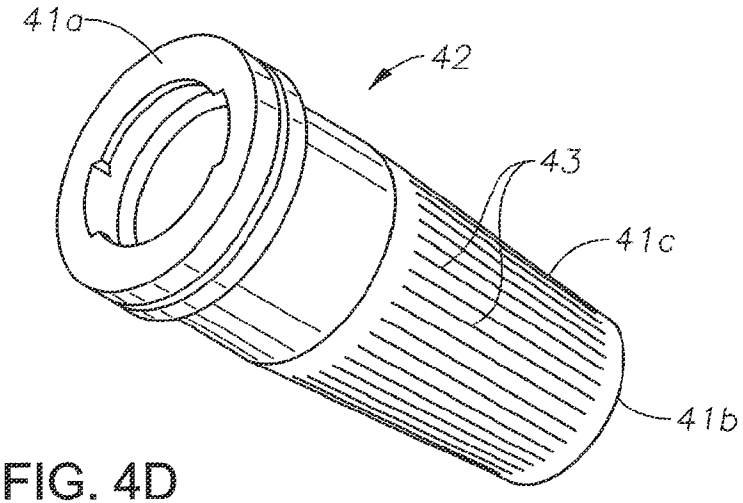

After exiting vacuum control area and flow dampener 44, the component stream enters an in-line hydrolyzer 46 comprised of two basic components, a cone insert 49 and vane member 51, the vane member 51 having a set of vanes defined by a plurality of angled or helical slots 53 formed therein for directing the component stream radially outwardly toward the I.D. of shell 40 to create a spiral flow regime as the flow enters the pressure drop/relaxation or hydration area 48 described below of the hydration shell 40. The total flow area of helical slots 53 is at least equal to the flow area through throat 45. With hydrolyzer slots 53 being helical, as shown in FIG. 4G, there is no straight line between shear slots 43 of shear device 42 and hydration area 48. Hydrolyzer 46 thus does not allow a direct line of turbulent flow from shear device 42 into hydration area 48. Cone insert 49 is located on the axis of shell 40 and tapers to a point in the upstream direction. Cone insert 49 splits the flow pattern into the helical slots 53, keeping a smooth flow. In contrast with cone insert 49, the upstream side of hydrolyzer 46 would be perpendicular to the flow and cause the polymer molecules in the fluid flow to directly impact against the flat surface perpendicular to the flow. Cone insert 49 keeps polymer molecule destruction to a minimum as the flow moves into hydration area 48.

Hydrolyzer 46 also has cone insert 50 located on its axis on its downstream end opposite cone insert 49. Cone insert 50 may be configured similar to cone insert 49 and tapers to a pointed apex in the downstream direction. Downstream cone insert 50 serves to eliminate a vortex as the fluid exits hydrolyzer slots 53.

As the component stream combined with chemicals moves from in-line shear device 42 to in-line hydrolyzer 46, a transformation takes place changing the fluid flow pattern from a high turbulent flow to a low turbulent flow regime. In-line hydrolyzer 46 allows for quick hydration of the chemicals, specifically the gel, by lining up the fluid flow path with the chemical molecules via a spherical flow pattern created by the geometric configuration of the angled slots 53 of in-line hydrolyzer 46. Before exiting shell 40, the component stream passes through an area of larger internal diameter, referred to as the pressure drop and hydration area 48, in which the fluid stream relaxes, allowing the chemicals that have been mixed into the stream time to properly hydrate prior to moving back to high turbulent flow inside coiled tubing unit 32 or tubular jointed pipe depending upon the particular application.

Hydration area 48 forms the portion of the downstream passage extending from the inlet to the outlet of shell 40. Hydration are 48 is an open, unobstructed passage of larger diameter and flow area than the inlet 38*a*, the outlet 38*b*, and throat 45. Hydration area 48 may be constant in inner diameter or it may have a downstream area 48*b* of slightly smaller inner diameter than an upstream area 48*a*, as shown in FIGS. 4A, 5 and 6. The smaller inner diameter downstream section 48*b* joins outlet 38*b*, which has an even smaller inner diameter. The length of hydration area 48 from the upstream end to outlet 38*b* is preferably greater than the length of shell 40 from inlet 38*a* to the upstream end of hydration area 48. The larger diameter of hydration chamber section 48*a* creates a larger flow area than the flow area through hydrolyzer 46, resulting in a pressure drop. The pressure within hydration area 48 is still high, however, in order to cause rapid hydration of the polymer. The larger flow area and the pressure drop causes the flow to be laminar within the hydration area 48 to facilitate hydration of the polymer.

In the example of FIG. 4A, shell 40 has a weld joining upstream hydration area 48*a* to the section containing hydrolyzer 46 and a weld joining upstream hydration area 48*b* to downstream hydration area 48*b*.

In the alternate embodiment shown in FIG. 5, the components that are the same as in FIG. 4A have the same numerals. The difference is that there is no weld in shell 40' joining upstream hydration area 48*a*' to the section containing hydrolyzer 46. There is no weld joining upstream hydration area 48*a*' to downstream hydration area 48*b*'. Rather shell 40' is an integral, single sleeve from the section containing flow dampener 44 to outlet 38*b*.

In the second alternate embodiment of FIG. 6, components that are the same as those in FIG. 4A are numbered the same. In this embodiment, the portion of shell 40" containing hydrolyzer 46 is joined to the portion containing upstream hydration area 48*a*" by a weld 55, rather than a threaded coupling as in FIGS. 4A and 5. Also, the portion of shell 40" containing upstream hydration area 48" is welded to the portion containing downstream hydration area 48*b*", as in FIG. 4A.

FIG. 7 illustrates in-line mixer 26 employed in a process of drilling out frac plugs 57, 59 from well 25. Cased well 25 has a vertical section and a horizontal section. The operator previously perforated a distal or lower section of the horizontal portion of cased well 25, and pumped frac fluids into lower perforations 61 to hydraulically fracture the earth formation. The operator then installed lower plug 57 and perforated a next upper zone with perforations 62. The operator pumped frac fluids into second perforations 62 and set a second plug 59. It is not uncommon for an operator to repeat this procedure twenty or more times, resulting in fifteen or more temporary plugs. Plugs 57, 59 are formed of composite, metal and elastomer.

To complete the well, the operator will drill out plugs 57, 59 and any others installed in well 25. One way to drill out plugs 57, 59 is to mount a drill bit 67 to a mud motor 69 attached to the lower end of coiled tubing 30. Drill bit 67 is of a type that will disintegrate plugs 57 when weight is applied and when rotated by mud motor 69. Fairly large fragments of plugs 57 occur during the drilling process. Coiled tubing 30 is deployed from a reel 63 through a guide 65 that directs and pushes coiled tubing 30 downward.

During the drilling process, manifold 12 feeds the intake of positive displacement pump 18 with a liquid that has unmixed or partially mixed components, particularly polymers designed to increase the viscosity of water contained in the fluid and friction reducers. Pump 18 increases the pressure to at least 250 psi, but typically at least 2500 psi and discharges the partially mixed fluid into in-line mixer 26 at a flow rate that is typically at least 20 gpm. As discussed above, in-line mixer 26 greatly increases the hydration of the polymer within the partially mixed fluid, increasing the viscosity of the fluid. The fluid is discharged out bit 67 and flows back to the surface out return line 36. The viscous fluid entrains fragments of plugs 59, 61 as it returns.

During the rapid passage through mixer 26, the viscosity of the fluid increases greatly. For example, the viscosity may increase from as low as 3 cp (centipoise) to about 19 cp. Being able to rapidly increase the viscosity of the fluid being circulated down coiled tubing 30 significantly speeds up the entire drilling out process.

Rather than coiled tubing, the drilling could alternately be performed with a workover rig employing sections of tubing with ends that are joined by threads. The process as described above is the same. The process as described above is the same and may be used with or without a mud motor. With jointed pipe, a roary table or surface swivel may be used to produce downhole rotation as required.

In-line mixer 26 could also be employed at the discharge of high pressure pumps to mix frac fluids during the fracturing process. Frac fluids contain proppants, which are abrasive, thus preferably not introduced at the inlet of in-line mixer 26. Preferably, an upstream positive displacement pump discharges fluid not containing proppants through in-line mixer to blend the components. The mixed fluid flows from in-line mixer through a choke to a blending unit to disperse the proppants. The choke installed downstream of in-line mixer 26 creates back pressure to replace the wellbore and frictions pressure artificially. The back pressure created by the choke creates sufficient pressure in the hydration chamber to make hydration of the water molecules with the polymer molecules. The mixed fluid, along with the proppants, then flows to a downstream positive displacement pump that pumps the frac fluid into the well.

Although it is not intended that the present disclosure be limited to a particular 1 to theory of operation, it is believed that the operating principle of the high pressure in-line shear device of the present disclosure is to elongate and unravel the large molecules comprising the component streams almost instantly upon injection into the flow manifold by a combination of pressure and geometric flow pattern. Elongating and unraveling, specifically gel molecules, allows the molecules to absorb fluid much more rapidly, leading to full molecular hydration and allowing the gel molecules to reach near maximum viscosity per molecule, at near full fluid saturation, in mere seconds in the downstream pressure drop area of the in-line hydrolyzer. The remaining hydration of the molecules takes place as the fluid and chemical mixture moves down the wellbore inside the coiled tubing or tubular jointed pipe. There are several advantages to this process, including more efficient use of chemicals, measurable outcome and predictability of viscosities being pumped downhole when using gels without having to pre-mix on surface, and the ability to "remotely" add chemicals into the fluid stream "on demand" in variable quantities to achieve desired outcomes.

Those skilled in the art who have the benefit of this disclosure will also recognize that changes can be made to the component parts of the present disclosure without changing the manner in which those component parts function and/or interact to achieve their intended result. All such changes, and others that will be clear to those skilled in the art from this description of the preferred embodiment(s) of the disclosure, are intended to fall within the scope of the following, non-limiting claims.

The invention claimed is:

1. A method of mixing and injecting a fluid into a well, comprising:

(a) providing a mixing device with an elongate shell, an inlet, an outlet, at least one shear producing element between the inlet and the outlet, and a hydration passage between the shear producing element and the outlet, the hydration passage having a flow area greater than a total shear flow area of the at least one shear producing element, greater than an inlet flow area of the inlet and greater than an outlet flow area of the outlet;

(b) connecting the inlet of the mixing device to the discharge of a positive displacement pump, and the outlet of the mixing device to an injection conduit leading into the well;

(c) introducing a viscosifier into a fluid flow, creating a partially mixed fluid, and flowing the partially mixed fluid to an intake of the positive displacement pump;

(d) with the pump, increasing the pressure of the partially mixed fluid to at least 250 psi and pumping the partially mixed fluid into the mixing device;

(e) flowing the partially mixed fluid through the shear producing element, causing separation of molecules in the viscosifier, and into the hydration passage, blending the molecules of the viscosifier with other components in the fluid flow in the hydration passage to create a more viscous fluid with greater viscosity than the partially mixed fluid flowing into the mixing device;

(f) discharging the more viscous fluid through the injection conduit into the well; and wherein flowing the partially mixed fluid into the shear producing element in step (e) creates turbulence, and the flow of the more viscous fluid within the hydration passage in step (f) is laminar.

2. The method according to claim 1, further comprising:

transitioning the partially mixed fluid from turbulent to laminar after the fluid leaves the shear producing element and enters the hydration passage.

3. The method according to claim 1, wherein:

step (a) further comprises mounting a plurality of vanes between the shear producing element and the hydration passage; and step (e) comprises with the vanes, swirling the fluid exiting the shear producing element as the fluid flows into the hydration passage.

4. The method according to claim 1, wherein the shear producing element comprises an orifice.

5. The method according to claim 1, wherein the viscosifier comprises a polymer.

6. An apparatus for mixing and injecting a fluid into a well, comprising:

a mixing device having an elongate shell, an inlet and an outlet;

at least one shear producing element in the shell between the inlet and the outlet for shearing a partially mixed fluid containing a viscosifier;

an open unobstructed hydration passage between the shear producing element and the outlet, the hydration passage having a flow area greater than a total shear flow area of the at least one shear producing element, greater than an inlet flow area of the inlet and greater than an outlet flow area of the outlet for causing the viscosifier after shearing to increase a viscosity of the fluid flowing through the hydration passage;

a positive displacement pump having a discharge connected to the inlet of the mixing device and capable of pumping into the mixing device the partially mixed fluid at a pressure of at least to 250 psi; and an injection conduit connected to the outlet of the mixing device and leading into the well for injecting the more viscous fluid flowing from the mixing device.

7. The apparatus according to claim 6, further comprising:

a plurality of vanes between the shear producing element and the hydration passage to swirl the fluid exiting the shear producing element as the fluid flows into the hydration passage.

8. The apparatus according to claim 6, wherein the shear producing element comprises an orifice.

9. A mixing apparatus for mixing a chemical additive contained in a fluid flow, comprising:

an elongate shell having an inlet and an outlet;

a flow passage between the inlet and the outlet, the flow passage having an upstream section with an inner diameter greater than an inner diameter of the inlet, a converging section joining the upstream section and converging to a throat section of smaller inner diameter than the inner diameter of the upstream section, a diverging section joining the throat section and diverging in inner diameter to a vane section having an inner diameter greater than the inner diameter of the throat section, and a hydration section joining the vane section and extending to the outlet, the hydration section having an inner diameter greater than the inner diameters of the inlet and the throat sections and an inner diameter of the outlet;

a shear device stationarily mounted in the upstream section and having at least one orifice through which fluid flowing through the flow passage passes; and a plurality of vanes stationarily mounted in the vane section to impart swirling to the fluid flowing from the diverging section.

10. The apparatus according to claim 9, wherein the shear device comprises:

a body having an open upstream end, a closed downstream end, a frusto-conical side wall portion decreasing in diameter in a downstream direction; wherein:

said at least one orifice comprises a plurality of elongated slits extending through and spaced around the side wall portion; and the body is stationarily mounted in the upstream section of the shell, and the inner diameter of the upstream section is greater than an outer diameter of the side wall portion so as to cause all fluid flowing into the inlet to flow through the slits.

11. The apparatus according to claim 9, wherein:

the shell has an axis passing through the flow passage from the inlet to the outlet; and a cone is mounted to the vanes on the axis, the cone having an upstream pointed apex to direct the fluid from the diverging section to the vanes.

12. A mixing apparatus for mixing a chemical additive contained in a fluid flow, comprising:

an elongate shell having an inlet and an outlet;

a flow passage between the inlet and the outlet, the flow passage having a longitudinal axis;

a shear device stationarily mounted in the flow passage, the shear device having a closed end, an open end, and a frusto-conical surface located between the closed end and the open end concentric with the axis, the closed end being smaller in outer diameter than the open end, the outer diameter of the closed end being smaller than a portion of the flow passage in which the open end is located, defining an annulus in the flow passage surrounding the closed end, the open end being in engagement with a portion of the flow passage in which the open end is located;

a plurality of elongated slits extending through and spaced around the frusto-conical surface, the slits and the open and closed ends defining a flow path through the annulus, the slits and the open end; and a helical vane stationarily mounted in the flow passage downstream from the shear device to impart swirling to the fluid flowing through the shear device.

13. The apparatus according to claim 12, wherein the slits are straight, have one end adjacent the closed end and another end adjacent the open end.

14. A method of mixing and injecting a fluid into a well, comprising:

(a) providing a mixing device with an elongate shell, an inlet, an outlet, at least one shear producing element between the inlet and the outlet, and a hydration passage between the shear producing element and the outlet, the hydration passage having a flow area greater than a total shear flow area of the at least one shear producing element, greater than an inlet flow area of the inlet and greater than an outlet flow area of the outlet;

(b) connecting the inlet of the mixing device to the discharge of a positive displacement pump, and the outlet of the mixing device to an injection conduit leading into the well;

(c) introducing a viscosifier into a fluid flow, creating a partially mixed fluid, and flowing the partially mixed fluid to an intake of the positive displacement pump;

(d) with the pump, increasing the pressure of the partially mixed fluid to at least 250 psi and pumping the partially mixed fluid into the mixing device;

(e) flowing the partially mixed fluid through the shear producing element, causing separation of molecules in the viscosifier, and into the hydration passage, blending the molecules of the viscosifier with other components in the fluid flow in the hydration passage to create a more viscous fluid with greater viscosity than the partially mixed fluid flowing into the mixing device;

(f) discharging the more viscous fluid through the injection conduit into the well; and wherein step (b) comprises sizing the inlet flow area of the mixing device to be at least equal to a flow area of the discharge of the pump.

15. A method of mixing and injecting a fluid into a well, comprising:

(a) providing a mixing device with an elongate shell, an inlet, an outlet, at least one shear producing element between the inlet and the outlet, and a hydration passage between the shear producing element and the outlet, the hydration passage having a flow area greater than a total shear flow area of the at least one shear producing element, greater than an inlet flow area of the inlet and greater than an outlet flow area of the outlet;

(b) connecting the inlet of the mixing device to the discharge of a positive displacement pump, and the outlet of the mixing device to an injection conduit leading into the well;

(c) introducing a viscosifier into a fluid flow, creating a partially mixed fluid, and flowing the partially mixed fluid to an intake of the positive displacement pump;

(d) with the pump, increasing the pressure of the partially mixed fluid to at least 250 psi and pumping the partially mixed fluid into the mixing device;

(e) flowing the partially mixed fluid through the shear producing element, causing separation of molecules in the viscosifier, and into the hydration passage, blending the molecules of the viscosifier with other components in the fluid flow in the hydration passage to create are viscous fluid with greater viscosity than the partially mixed fluid flowing into the mixing device;

(f) discharging the more viscous fluid through the injection conduit into the well; and wherein step (b) comprises sizing the outlet flow area of the mixing device to be at least equal to a flow area of an inlet of the conduit.

16. A method of mixing and injecting a fluid into a well, comprising:

(a) providing, a mixing device with an elongate shell, an inlet, an outlet, at least one shear producing element between the inlet and the outlet, and a hydration passage between the shear producing element and the outlet, the hydration passage having a flow area greater than a total shear flow area of the at least one shear producing element, greater than an inlet flow area of the inlet and greater than an outlet flow area of the outlet;

(b) connecting the inlet of the mixing device to the discharge of a positive displacement pump, and the outlet of the mixing device to an injection conduit leading into the well;

(c) introducing a viscosifier into a fluid flow, creating partially mixed fluid, and flowing the partially mixed fluid to an intake of the positive displacement pump;

(d) with the pump, increasing the pressure of the partially mixed fluid to at least 250 psi and pumping the partially mixed fluid into the mixing device;

(e) flowing the partially mixed fluid through the shear producing element, causing separation of molecules in the viscosifier, and into the hydration passage, blending the molecules of the viscosifier with other components in the fluid flow in the hydration passage to create a more viscous fluid with greater viscosity than the partially mixed fluid flowing into the mixing device;

(f) discharging the more viscous fluid through the injection conduit into the well; and wherein step (a) comprises sizing the total shear flow area to be at least equal to the inlet flow area and to the outlet flow area.

17. A method of mixing and injecting a fluid into a well, comprising:

(a) providing a mixing device with an elongate shell, an inlet, an outlet, at least one shear producing element between the inlet and the outlet, and a hydration passage between the shear producing element and the outlet, the hydration passage having a flow area greater than a total shear flow area of the at least one shear producing element, greater than an inlet flow area of the inlet and greater than an outlet flow area of the outlet;

(b) connecting the inlet of the mixing device to the discharge of a positive displacement pump, and the outlet of the mixing device to an injection conduit leading into the well;

(c) introducing a viscosifier into a fluid flow, creating partially mixed fluid, and flowing the partially mixed fluid to an intake of the positive displacement pump;

(d) with the pump, increasing the pressure of the partially mixed fluid to at least 250 psi and partially mixed fluid into the mixing device;

(e) flowing the partially mixed fluid through the shear producing element, causing separation of molecules in the viscosifier, and into the hydration passage, blending the molecules of the viscosifier with other components in the fluid flow in the hydration passage to create a more viscous fluid with greater viscosity than the partially mixed fluid flowing into the mixing device;

(f) discharging the more viscous fluid through the injection conduit into the well;

wherein:

step (a) further comprises mounting a venturi between the shear producing element and the hydration passage, the venturi having a converging portion leading to a throat and a diverging portion leading from the throat in a downstream direction;

step (e) comprises creating turbulence as the partially mixed fluid flows through the shear producing element; and step (e) further comprises diminishing the turbulence with the venturi as the fluid flows through the venturi to the hydration passage.

18. A method of mixing and injecting a fluid into a well, comprising:

(a) providing a mixing device with an elongate shell, an inlet an outlet, at least one shear producing element between the inlet and the outlet, and a hydration passage between the shear producing element and the outlet, the hydration passage having a flow area greater than a total shear flow area of the at least one shear producing element, greater than an inlet flow area of the inlet and greater than an outlet flow area of the outlet;

(b) connecting the inlet of the mixing device to the discharge of a positive displacement pump, and the outlet of the mixing device to an injection conduit leading into the well;

(c) introducing a viscosifier into a fluid flow, creating a partially mixed fluid, and flowing the partially mixed fluid to an intake of the positive displacement pump;

(d) with the pump, increasing the pressure of the partially mixed fluid to at least 250 psi and pumping the partially mixed fluid into the mixing device;

(e) flowing the partially mixed fluid through the shear producing element, causing separation of molecules in the viscosifier, and into the hydration passage, blending the molecules of the viscosifier with other components in the fluid flow in the hydration passage to create a more viscous fluid with greater viscosity than the partially mixed fluid flowing into the mixing device;

(f) discharging the more viscous fluid through the injection conduit into the well;

wherein the well contains a plurality of temporary frac plugs, and the method further comprises:

attaching a drill bit to a lower end of the injection conduit, disintegrating the frac plugs with the drill bit, and circulating fragments of the frac plugs to the surface with the fluid being injected into the well.

19. An apparatus for mixing and injecting a fluid into a well, comprising:

a mixing device having an elongate shell, an inlet and an outlet;

at least one shear producing element in the shell between the inlet and the outlet for shearing a partially mixed fluid containing a viscosifier;

a hydration passage between the shear producing element and the outlet, the hydration passage having a flow area greater than a total shear flow area of the at least one shear producing element, greater than an inlet flow area of the inlet and greater than an outlet flow area of the outlet for causing the viscosifier after shearing to increase a viscosity of the fluid flowing through the hydration passage;

a positive displacement pump having a discharge connected to the inlet of the mixing device and capable of pumping into the mixing device the partially mixed fluid at a pressure of at least to 250 psi;

an injection conduit connected to the outlet of the mixing device and leading into the well for in the more viscous fluid flowing from the mixing device; wherein:

the inlet flow area of the mixing device is at least equal to a discharge flow area of the pump;

the conduit has an inlet flow area at least equal to the outlet flow area of the mixing device; and the total shear flow area is at least equal to the inlet flow area and to the outlet flow area.

20. An apparatus for mixing and injecting a fluid into a well, comprising:

a mixing device having an elongate shell, an inlet and an outlet;

at least one shear producing element in the shell between the inlet and the outlet for shearing a partially mixed fluid containing a viscosifier;

a hydration passage between the shear producing element and the outlet, the hydration passage having a flow area greater than a total shear flow area of the at least one shear producing element, greater than an inlet flow area of the inlet and greater than an outlet flow area of the outlet for causing the viscosifier after shearing to increase a viscosity of the fluid flowing through the hydration passage;

a positive displacement pump having a discharge connected to the inlet of the mixing device and capable of pumping into the mixing device the partially mixed fluid at a pressure of at least to 250 psi;

an injection conduit connected to the outlet of the mixing device and leading into the well for injecting the more viscous fluid flowing from the mixing device; and a venturi between the shear producing element and the hydration passage, the venturi having a converging portion leading to a throat and a diverging portion leading from the throat in a downstream direction.

21. An apparatus for mixing and injecting a fluid into a well, comprising:

a mixing device having an elongate shell, an inlet and an outlet;

at least one shear producing element in the shell between the inlet and the outlet for shearing a partially mixed fluid containing a viscosifier;

a hydration passage between the shear producing element and the outlet, the hydration passage having a flow area greater than a total shear flow area of the at least one shear producing element, greater than an inlet flow area of the inlet and greater than an outlet flow area of the outlet for causing the viscosifier after shearing to increase a viscosity of the fluid flowing through the hydration passage;

a positive displacement pump having a discharge connected to the inlet of the mixing device and capable of pumping into the mixing device the partially mixed fluid at a pressure of at least to 250 psi;

an injection conduit connected to the outlet of the mixing device and leading into the well for injecting the more viscous fluid flowing from the mixing device; and wherein said at least one shear producing element comprises:

a frusto-conical body having a decreasing diameter in a downstream direction; and a plurality of elongated slits extending through and spaced around the body.

22. An apparatus for mixing and injecting a fluid into a well, comprising:

a mixing device having an elongate shell, an inlet and an outlet;

at least one shear producing element in the shell between the inlet and the outlet for shearing partially mixed fluid containing a viscosifier;

a hydration passage between the shear producing element and the outlet, the hydration passage having a flow area greater than a total shear flow area of the at least one shear producing element, greater than an inlet flow area of the inlet and greater than an outlet flow area of the outlet for causing the viscosifier after shearing to increase a viscosity of the fluid flowing through the hydration passage;

a positive displacement pump having a discharge connected to the inlet of the mixing device and capable of pumping into the mixing device the partially mixed fluid at a pressure of at least to 250 psi;

an injection conduit connected to the outlet of the mixing device and leading into the well for injecting the more viscous fluid flowing from the mixing device; and wherein a length of the shell from a beginning of the hydration passage to the outlet is greater than a length of the shell from the inlet to the beginning of the hydration passage.

23. An apparatus for mixing and injecting a fluid into a well, comprising:

a mixing device having an elongate shell, an inlet and an outlet;

means for flowing into the mixing device at a pressure of at least 250 psi a partially mixed fluid containing a viscosifier;

shear producing means in the shell between the inlet and the outlet for shearing the fluid flowing into the device;

swirling means in the shell downstream from the shear producing means for swirling the partially mixed fluid exiting the shear producing means;

a hydration chamber means in the shell downstream from the swirling means for transitioning the flow of partially mixed fluid from turbulent flow to laminar flow; and downstream connection means for connecting the outlet to an injection conduit leading into the well for injecting fluid flowing from the mixing device.

24. An apparatus for mixing and injecting a fluid into a well, comprising:

a mixing device having an elongate shell, an inlet and an outlet;

shear producing means in the shell between the inlet and the outlet for shearing a partially mixed fluid containing a viscosifier;

swirling means in the shell downstream from the shear producing means for swirling the partially mixed fluid exiting the shear producing means;

upstream connection means for connecting the inlet to a discharge of a positive displacement pump;

downstream connection means for connecting the outlet to an injection conduit leading into the well for injecting fluid flowing from the mixing device; wherein the shear producing means comprises:

a shear device stationarily mounted in the shell, the shear device having a closed end, an open end, and a frusto-conical surface located between the closed end and the open end, the closed end being smaller in outer diameter than the open end, the outer diameter of the closed end being smaller than an interior wall portion of the shell in which the shear device is located, defining an annulus in the shell around the closed end, the open end being in engagement with the interior wall portion; and a plurality of elongated slits extending through and spaced around the frusto-conical surface, the slits and the open and closed ends defining a flow path through the annulus, the slits and the open end.

25. A method of mixing and injecting a fluid into a well, comprising:

(a) providing a mixing device with an elongate shell, an inlet, an outlet, at least one shear producing element between the inlet and the outlet, and a swirling device between the shear producing element and the outlet;

(b) connecting the inlet of the mixing device to the discharge of a positive displacement pump, and the outlet of the mixing device to an injection conduit leading into the well;

(c) introducing a viscosifier into a fluid flow, creating a partially mixed fluid, and flowing the partially mixed fluid to an intake of the positive displacement pump;

(d) with the pump, increasing the pressure of the partially mixed fluid to at least 250 psi and pumping the partially mixed fluid into the mixing device;

(e) flowing the partially mixed fluid through the shear producing element, causing separation of molecules in the viscosifier, blending the molecules of the viscosifier with other components in the fluid flow in the mixing device to create a more viscous fluid with greater viscosity than the partially mixed fluid flowing into the mixing device;

(f) swirling the more viscous fluid exiting the shear producing element;

(g) flowing the more viscous fluid from the shear producing element into a hydration chamber and creating a laminar flow within the hydration chamber; and (h) discharging the more viscous fluid from the hydration chamber through the injection conduit into the well.

* * * * *